US005555939A

United States Patent [19]

Berger et al.

[11] Patent Number: 5,555,939

[45] Date of Patent: Sep. 17, 1996

[54] APPARATUS FOR EXTINGUISHING CHIMNEY FIRES

[76] Inventors: Martin T. Berger, 111 5th Ave. S.W.; Terry T. Then, 104 1st St. N.E., both of Epworth, Iowa 52045

[21] Appl. No.: 549,280

[22] Filed: Oct. 27, 1995

[51] Int. Cl.[6] ..... A62C 3/04

[52] U.S. Cl. ..... 169/54; 15/104.069; 15/249.3

[58] Field of Search ..... 169/54; 15/104.067, 15/104.069, 249.3

[56] References Cited

U.S. PATENT DOCUMENTS

| | | | |
|---|---|---|---|
| 1,104,030 | 7/1914 | Willat . | |
| 1,398,155 | 11/1921 | Rork | 15/104.069 |
| 1,569,203 | 1/1926 | Rice et al. | 15/104.069 |
| 4,028,769 | 6/1977 | Coviello et al. | 15/249.3 |
| 4,454,625 | 6/1984 | Kern | 15/249.3 |
| 4,543,681 | 11/1985 | Ryden . | |
| 4,657,597 | 4/1987 | Wolf et al. | 15/104.069 |
| 4,807,320 | 2/1989 | Labrecque . | |
| 5,096,262 | 3/1992 | Foullois | 15/104.069 |

FOREIGN PATENT DOCUMENTS

| | | |
|---|---|---|
| 2331900 | 3/1911 | Germany . |
| 270833 | 2/1914 | Germany . |

*Primary Examiner*—Gary C. Hoge
*Attorney, Agent, or Firm*—James C. Nemmers

[57] ABSTRACT

A portable apparatus for extinguishing chimney fires. The apparatus includes a cleaning device consisting of a plurality of chains on a ring attached to the end of a chain that passes over idler pulleys and is wound on a drum that is manually turned by a crank and locked at any desired position. The pulleys and drum are mounted on a supporting structure that includes adjustable telescoping legs so that the apparatus can be setup on a roof with the cleaning device in a position to be lowered into the top of the chimney to dislodge the burning material that had accumulated on the chimney liner.

11 Claims, 1 Drawing Sheet

APPARATUS FOR EXTINGUISHING CHIMNEY FIRES

BACKGROUND OF THE INVENTION

Chimney fires are not uncommon happenings, and most chimney fires are extinguished by removing the source of the fuel that causes the fire. The "fuel" for a chimney fire results from a build up of soot and creosote on the inner lining of the chimney due to usage of a fireplace or wood-burning stove. The accumulation of this fuel is especially severe when soft woods, such as pine, or green wood that is not sufficiently dried is burned in a fireplace or stove. If the user is not diligent in cleaning the chimney, the build up can be sufficient to cause a fire. Since a chimney fire can generate enough heat to cause considerable damage to the chimney itself and generate enough radiant heat to ignite the building surrounding the chimney, a devastating building fire can result. Therefore, if a chimney fire occurs, it is important to extinguish the fire as quickly and safely as possible.

There are only four basic methods that are available in extinguishing any fire, including a chimney fire. In one method, the heat of the fire can be removed by the application of water, for example. However, removing the heat and cooling a chimney fire with water can cause the chimney to crack, often doing more damage than the fire itself.

Another known method of extinguishing a fire is to reduce the oxygen level below that required to support combustion. Reduction of the oxygen level can be accomplished by smothering the fire with a dry powder fire extinguisher. However, removing the oxygen supply to the fire is difficult to achieve in a chimney fire. Occasionally, the fire can be slowed, but not extinguished, in a chimney by closing a damper to limit the oxygen supply or by utilizing a dry powder fire extinguisher. Neither of these techniques has been effective in extinguishing a chimney fire. In addition, a technique that has been used in chimney fires is to use a "chimney stick" that will ignite a separate fire at the bottom of the chimney so that the smoke from the chimney stick will fill the chimney and replace the available oxygen. However, the smoke from the chimney stick presents another hazard to any firefighter on the roof.

A third basic method of extinguishing a fire is to interrupt the chemical reaction of the fire process. This method requires the use of a specialized fire extinguisher and is primarily used around sensitive electrical equipment such as computers. The method is relatively difficult to use and is not especially effective for a chimney fire. Therefore it is rarely used.

The last know method of extinguishing a fire is to remove the fuel source, such as by shutting off a gas line or stopping a gas leak. In the case of a chimney, regular cleaning of the chimney should prevent the build up of the fuel source and lessen the risk of fire. However, once a fire starts in a chimney, the preferred and most logical way to extinguish the fire is to remove the fuel source for the fire. Presently, this is the preferred method of extinguishing chimney fires since it involves the least risk of causing additional property damage.

At the present time, once the fire has ignited, removing the source of fuel from the fire in a chimney is accomplished by removing the build up of combustible material in the chimney during the fire. This is commonly done by introducing into the chimney a chain or other heavy cleaning device to dislodge the buildup of combustible material from the chimney liner. Obviously, this can expose the fire fighter to several dangers, including falling from steep roofs especially when icy or slippery, injury from flames or sparks emanating from the chimney and inhaling smoke and particles of combustion. Moreover, any item introduced into the chimney for cleaning will quickly heat to a hazardous temperature, and although asbestos gloves were available for handling the overheated cleaning device, asbestos gloves are no longer readily available due to the health concerns of asbestos. Normal fire fighting gloves cannot provide a sufficient level of protection.

As fireplaces and wood burning stoves become more common in homes, the number of chimney fires has increased substantially. There is therefore a need for a satisfactory device that can be used to remove the source of the fuel causing the chimney fire by cleaning the chimney while it is on fire. Any such device must be easy to use, minimize the dangers to the fire fighters and yet be effective as well as relatively inexpensive to manufacture.

Moreover, there is a need for a device for emergency fire use in chimney fires that is adaptable to varying sizes of chimneys and which can be quickly set up for use.

SUMMARY OF THE INVENTION

The apparatus of the invention utilizes cleaning devices consisting of a plurality of chains on a ring or a heavy metal rod suspended on a ring. These cleaning devices are attached to a hook at the end of a chain that passes over idler pulleys and is wound on a drum that is manually turned by a crank. The pulleys and drum are mounted on a supporting structure that includes adjustable telescoping legs so that the apparatus can be setup on roofs of different contours and pitches. The apparatus is portable and therefore can be quickly and easily set up with the cleaning device suspended over the top of the chimney. The cleaning device is lowered into and removed from the chimney without the necessity of the fire fighter having to directly touch or handle any of the hot cleaning devices.

DESCRIPTION OF THE PREFERRED EMBODIMENT OF THE INVENTION

Figure 2:
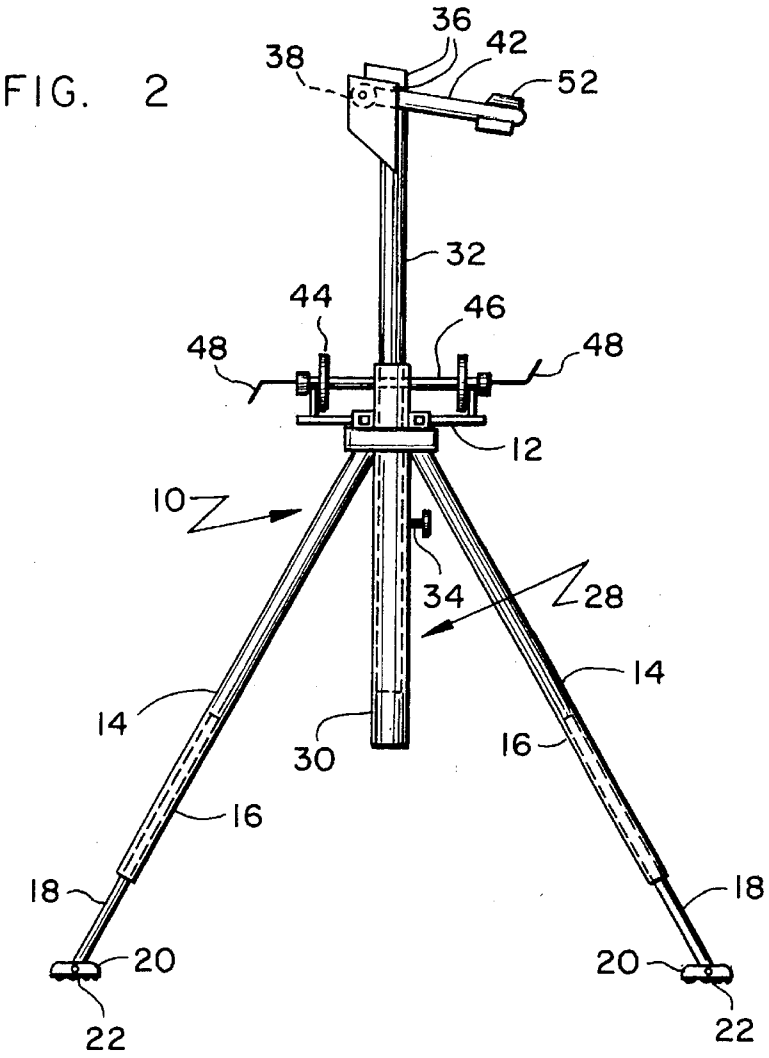
FIG. 2 is a front elevational view with the chain and cleaning device not shown so as to more clearly illustrate the drum and idler arrangement.
Figure 1:
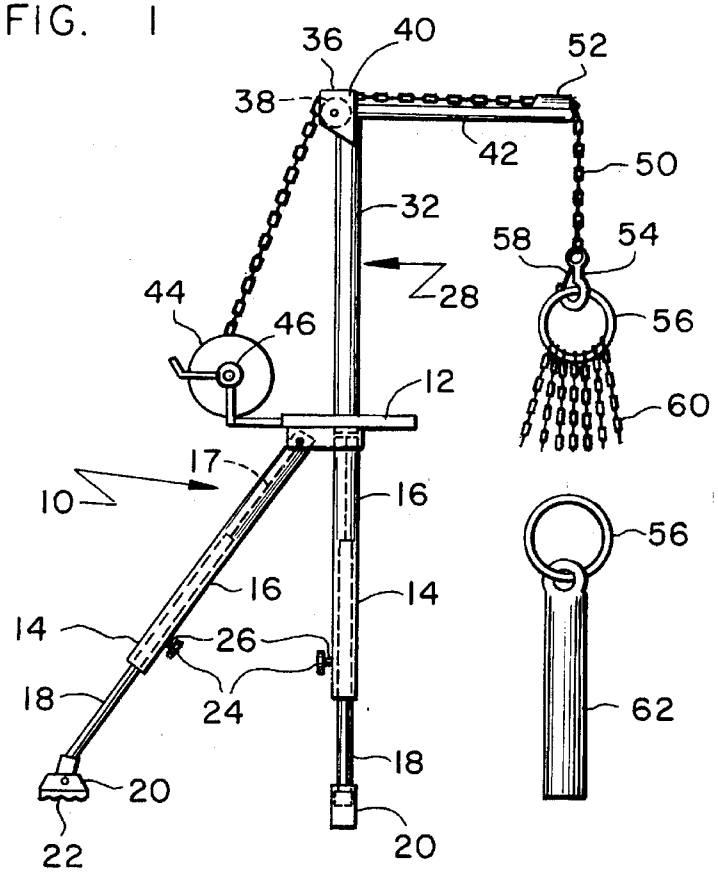
FIG. 1 is a side elevational view of the device and shows two alternate cleaning devices.

The apparatus of the invention has a supporting structure indicated generally by the reference numeral 10, which supporting structure 10 includes a main supporting bracket 12 to which three supporting legs 14 are pivotly attached at their upper ends. Each leg 14 consists of a tubular upper portion 16 and a tubular lower portion 18 of a smaller diameter so that the lower portion 18 is telescoped inside of the upper portion 16. A safety chain 17 is connected to the upper end of the lower portion 18 and to the upper end of the upper portion 16 to prevent the portions 16 and 18 from becoming separated. The chain 17 is sufficiently long to allow full adjustability of the length of each leg 14, but chain 17 will not allow the lower portion 18 to become disengaged from the upper portion 16. This prevents the lower portion 18 from coming loose and falling from the roof during setup or take down of the apparatus, thus minimizing the possibility of causing personal injury or property damage. Each leg 14 has pivotly connected to the lower portion 18 a foot member 20 that has frictional material 22 secured to its lower surface. A lock 24 is provided for each leg 14 to provide for locking the lower portion 18 relative to the upper portion 16 in the desired position so that the apparatus can be set up on roofs of varying pitches and contours. The lock 24 can be of any suitable type, many of which are known to those skilled in the art and which includes a threaded member 26 that is threaded into the upper portion 16 so that it engages the lower portion 18 to lock it in place when the threaded member 26 is tightened.

Also supported on the main support bracket 12 and extending vertically upwardly and downwardly from the bracket 12 is a main support 28. The main support 28 includes an outer tube 30 and an inner tube 32 telescoped inside of the outer tube 30. Outer tube 30 is welded or otherwise suitably secured to the main support bracket 12. The inner tube 32 is turnable through 360° within the outer tube 30 and its vertical position can be adjusted to position the inner tube 32 at the desired height. Once properly positioned, the inner tube 32 is locked in place relative to the outer tube 30 by a lock 34 similar to the lock 24. The upper end of the inner tube 32 supports a pair of spaced apart brackets 36 through which an axle 38 extends to support an idler pulley 40. The brackets 36 also support a horizontal chain support arm 42 which extends outwardly and away from the apparatus.

Also mounted on the main supporting bracket 12 is a drum 44 containing an axle 46 which is turnable by cranks 48 which are preferably self-locking at any position by reversing the direction of rotation. A chain 50 has one end secured to the axle 46, and when the cranks 48 are turned, the chain 50 is wrapped or unwrapped from the drum 44. The chain 50 extends upwardly and over the idler pulley 40 and along the horizontal support arm 42. The outer end of the support arm 42 has a pair of guide members 52 which maintain the chain along the support arm 42 and allow it to descend naturally by gravity. At the free end of the chain 50 is a hook 54 to which a ring 56 is removably attached. Ring 56 is held in place on the hook 54 by a safety catch 58.

The ring 56 supports the cleaning device which consists of a plurality of short lengths of chain 60. In the alternative, a heavy bar or rod 62 can be suspended from the hook 54.

In use, the fire fighters carry the portable apparatus onto the roof and place it adjacent to the chimney containing the fire. The length of the supporting legs 14 are then each adjusted using the telescoping lower portions 18 and upper portions 16. Safety chains 17 prevent the lower portions 18 from becoming separated from the upper portions 16. After the legs 14 are at the proper length so that the apparatus is stable, the legs 14 are locked using the lock 24 on each leg 14. The apparatus is properly set up and stable when the main support 28 is positioned in a substantially vertical orientation. The desired cleaning device 60 or 62 is then placed on the hook 54. The entire setup can be quickly accomplished in less than a minute. Once set up, the firefighter uses the cranks 48 to lower the cleaning device into the chimney, and the device is raised and lowered until the accumulation of soot and creosote causing the fire are loosened and drop to the bottom of the chimney. The burning material can then be accessed through the chimney cleanout and quickly extinguished.

It will be evident from the foregoing description that the invention provides a portable apparatus that is quick and easy to set up, and which can be used for a chimney of any size or placement on a roof. The apparatus eliminates any handling of the cleaning device by the fire fighters, and thus is safe to use. All fire fighters will be positioned away from the chimney and thus not subject to any flames, sparks or harmful particles or gases of combustion. The fire fighters can wear their normal fire fighting gloves since they will not be handling extremely hot cleaning devices.

Having thus described the device in connection with certain preferred embodiments of it, it will be evident that various revisions and modifications can be made to the preferred embodiments without departing from the spirit and scope of the invention. It is our intention however that all such revisions and modifications that are obvious to those skilled in the art will be included within the scope of the following claims.

What is claims is as follows:

1. A portable apparatus for extinguishing chimney fires from the roof of a structure containing the chimney, said apparatus comprising: a main support bracket; a plurality of legs pivotally attached to and extending downwardly from the main support bracket so as to engage the roof; first adjustment means combined with each leg to provide for adjustment of the length of each leg independently of the other legs; a main support member extending upwardly from the main support bracket and terminating in an upper end, the main support member being rotatable relative to the support bracket; second adjustment means combined with the main support member to provide for adjustment of the height of the upper end of the main support member; a support arm extending outwardly from the upper end of the main support member and terminating in an outer end; a cleaner support line operatively connected to the main support bracket and carried by the support arm so that its free end extends downwardly from the outer end of the support arm; a cleaning device attached to the free end of the cleaner support line; and means to lower and raise the cleaning device by extending and retracting the cleaner support line.

2. The portable apparatus of claim 1 in which the means to lower and raise the cleaning device includes a turnable drum mounted on the main support bracket, and the end of the cleaner support line opposite the free end is wound around the drum, turning of the drum extending and retracting the cleaner support line.

3. The portable apparatus of claim 2 in which there is a hand crank operatively connected to the drum to provide for manual turning of the drum.

4. The portable apparatus of claim 1 in which the cleaning device includes a ring and a plurality of heavy metal chain pieces attached to the ring, and means is provided to removably attach the ring to the free end of the cleaner support line.

5. The portable apparatus of claim 1 in which the cleaning device includes a ring and a heavy metal bar attached to the ring, and means is provided to removably attach the ring to the free end of the cleaner support line.

6. The portable apparatus of claim 1 in which each leg is provided with means to increase the friction between the leg and the roof.

7. The portable apparatus of claim 6 in which the means to increase the friction between each leg and the roof includes a foot member pivotly connected to each leg, the foot member having frictional material secured to its lower surface.

8. The portable apparatus of claim 1 in which the first adjustment means for each leg includes a lock to lock the leg at the desired length.

9. The portable apparatus of claim 1 in which each leg has an outer tube and an inner tube, the inner tube being slidable inside the outer tube to provide for adjustment of the length of the leg.

10. The portable apparatus of claim 9 in which there is a flexible connector connecting the inner tube to the outer tube so as to prevent the inner and outer tubes from becoming separated, the flexible connector being contained inside the outer tube.

11. The portable apparatus of claim 10 in which the first adjustment means for each leg includes a lock to lock the leg at the desired length.

* * * * *